United States Patent [19]

Lai

[11] Patent Number: 4,848,610

[45] Date of Patent: Jul. 18, 1989

[54] STRUCTURE OF SHELF AT BALCONY

[76] Inventor: Ching Ming Lai, 3-2 Fl. No. 450 Chen-Der Road, Taipei, Taiwan

[21] Appl. No.: 181,000

[22] Filed: Apr. 13, 1988

[30] Foreign Application Priority Data

Sep. 11, 1987 [GB] United Kingdom ..... 8721462

[51] Int. Cl.[4] ..... A47F 5/08

[52] U.S. Cl. ..... 211/90; 211/88; 211/186; 108/46; 108/152; 248/236

[58] Field of Search ..... 211/90, 88, 190, 149, 211/182, 183, 186; 248/208, 236, 214; 108/44, 46, 152

[56] References Cited

U.S. PATENT DOCUMENTS

| | | | |
|---|---|---|---|
| 1,224,127 | 5/1917 | Bartlett | 211/90 X |
| 1,335,239 | 5/1920 | Huber | 211/90 X |
| 2,645,537 | 7/1953 | Brath et al. | 108/46 |
| 2,718,874 | 9/1955 | Dunn | 211/90 X |
| 2,758,456 | 8/1956 | Wheeler | 248/236 X |
| 4,045,104 | 8/1977 | Peterson | 211/182 X |
| 4,653,652 | 5/1987 | Avati | 211/182 X |

*Primary Examiner*—Alvin C. Chin-Shue

*Attorney, Agent, or Firm*—Fleit, Jacobson, Cohn, Price, Holman & Stern

[57] ABSTRACT

An improved shelf structure has a peripheral frame with side frame members. A pair of opposed side frame members carry respective slides which can be adjusted for positioning lengthwise along the side frame members. The slides carry a bracing assembly having pivoted U-shaped braces which can be crossed over and held in place by pegs on one of the braces. Adjustment of the cross-over point of the braces and adjustment of the slides along the side frame members allows the bracing assembly to be suitably adjusted to support the shelf in a horizontal plane.

5 Claims, 8 Drawing Sheets

STRUCTURE OF SHELF AT BALCONY

BACKGROUND OF THE INVENTION:

A majority of people residing in apartments in general, will install some shelves on their balconies for disposing flowers or other articles so as to decorate their living surroundings with plants. However, if the said shelves are permanently fixed, it is troublesome, in times of moving, to remove them from the balconies and regrettable to abandon them. Therefore, some ingenious men invented a shelf supported by two U-shaped frames crossing each other and locked by some cataches and fixed onto the enclosure or railing as shown in FIG. 10 in order to conveniently remove it therefrom. Nevertheless, it remains bulky and cumbersome for packing and handling and it will cost more for packing.

In view of the above, the present inventor has developed an improved shelf structure through his research and design for a number of years to as to eliminated the foregoing drawbacks.

The major object of the present invention is to offer an improved shelf structure of shelf at balcony wherein a frame and backing are installed onto the enclosure or railing through sliding fittings in cooperation with an adjustable depending brace assembly.

Another object of the present invention is to offer an improved shelf structure which can be easily disassembled so as to minimize its packing space.

SUMMARY OF THE INVENTION

The present invention is related to an improved shelf structure is composed of a peripheral frame having front, back and side frame members. Shelf retainers are inserted into slots in the back frame element the said side frame elements have sliders which support a depending brace in the form of a bipod which can be moved along the side frame members. The bipod has two pivotal U-shaped arms which can be crossed over and fixed by pegs on one of the arms. The bipod structure as a whole can be urged against the lower end of an enclosure or railing with the said monopads crossing each other and the entire structure can be installed on a railing or enclosure through the retainers. Uprights and crossbars may be additionally installed above the frame to form a shelf surround in order to prevent articles disposed thereon from falling off, and to carry or store the shelf, it can be easily disassembled so as to minimize its packing volume and to achieve its specially convenient practicability.

DESCRIPTION OF THE PREFERRED EMBODIMENT

Figure 1:
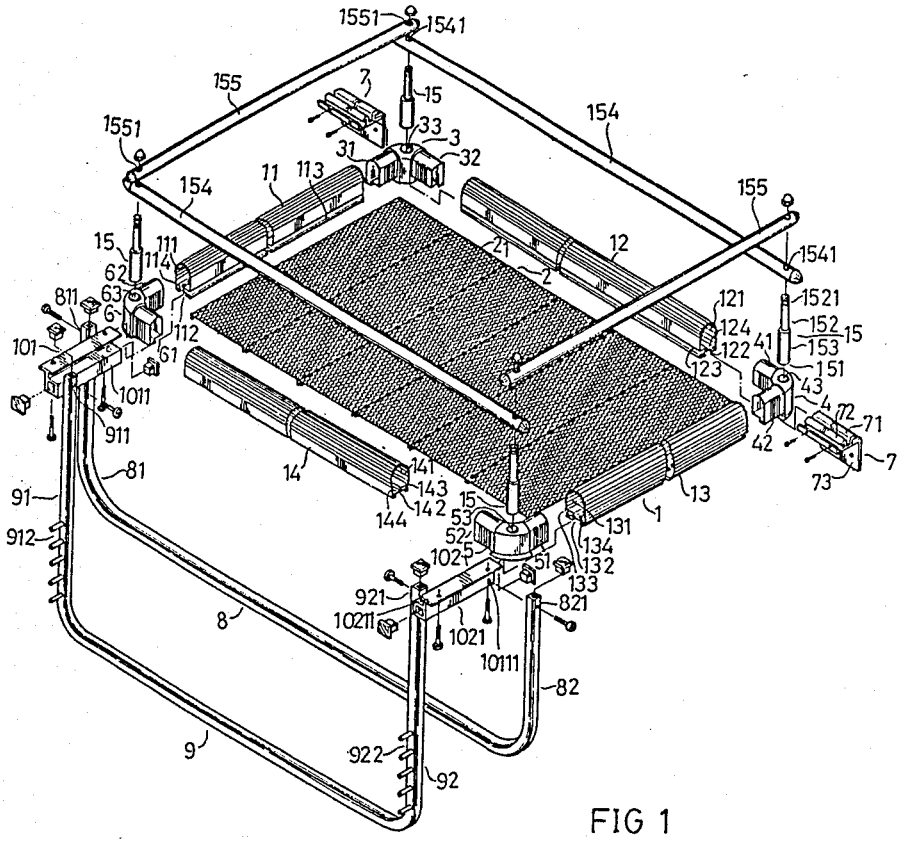
FIG. 1 is an exploded view of components of the present invention.
Figure 2:
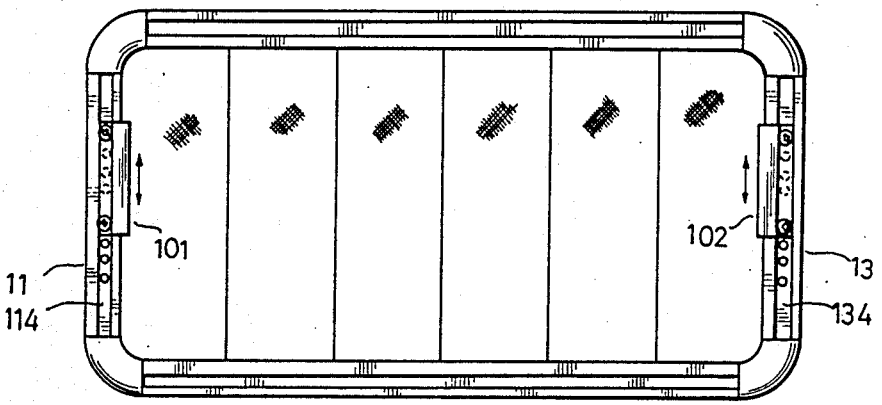
FIG. 2 is a bottom view of a frame of the present invention.
Figure 3:
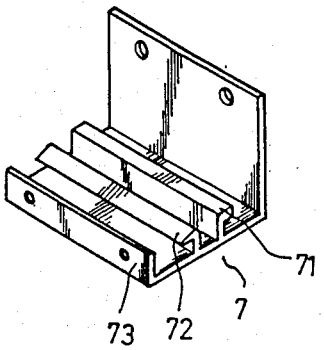
FIG. 3 is a perspective view of another retainer of the present invention.
Figure 4:
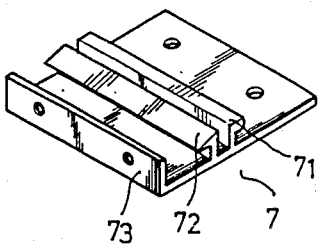
FIG. 4 is a perspective view of still another retainer of the present invention.
Figure 9:
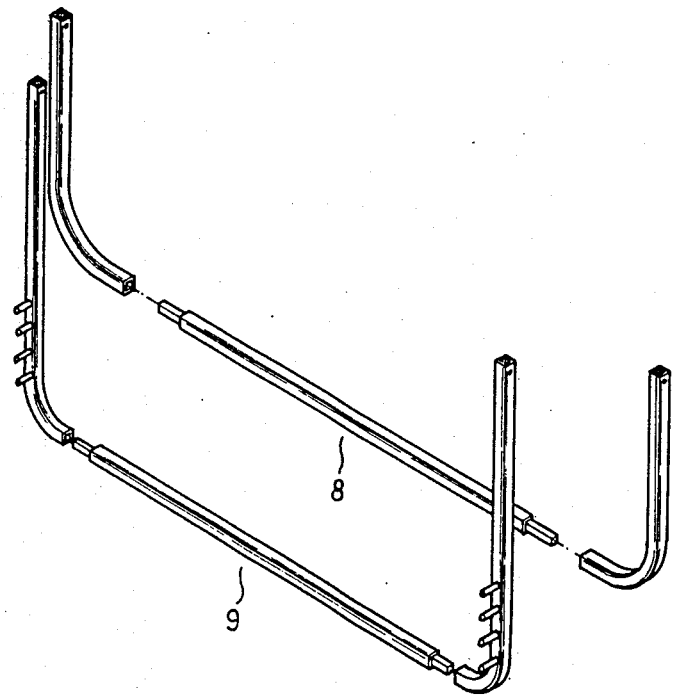
FIG. 9 is an exploded view of the bipod of the present invention.
Figure 10:
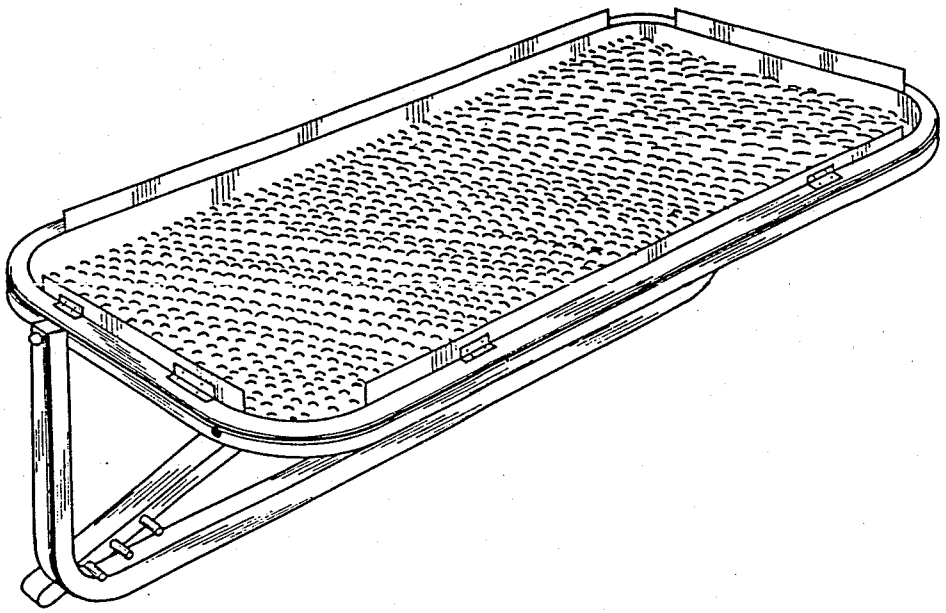
FIG 10 Prior Art
FIG. 10 is a perspective view of a conventional shelf.

As shown in FIG. 1, the shelf structure has a side frame made up of hollow elongated member (11), (12), (13), (14) each of which is provided with an elongate through-bore (111), (121), (131), (141), and the bottom of which is provided with sliding slot (112), (122), (132), (142) on one side of each side frame member is provided an elongate notch (113), (123), (133), (143), and a group of holes is provided on a lower flange (114), (124), (134), (144) as each side frame member (as shown in FIG. 2), holes (33), (43), (53), (63) are provided in L-shaped corner blocks (3), (4), (5), (6), which have end portions (31), (32), (41), (42), (51), (52), (61), (62) to fit in the ends of the respective side frame members. Retainers (7) provided with guide flange (71), (72) and attachment flanges (73) which may be in the form of a flat plate or bent vertically downward or upward as desired (as shown in FIGS. 3 and 4), are slidingly received in side frame member R. Holes are provided at the head end of each side bar (81), (91), (82), (92) of respective U-shaped monopad braces (8), (9), and a group of protruded bars or pegs (912), (922) are provided at suitable spacings on the side bars (91), (92) of monopad B(9). Each monopod (8), (9) may be dismountable (as shown in FIG. 9) and composed of two L-shaped bars and a crossbar respectively.

The upper ends of the respective monopods (8), (9) are pivotally connected to respective slides (1011), (1021) having upper flanges (101), (102) which slide in the respective side members (11), (13) and which extend through the slots (112), (132).

Figure 5:
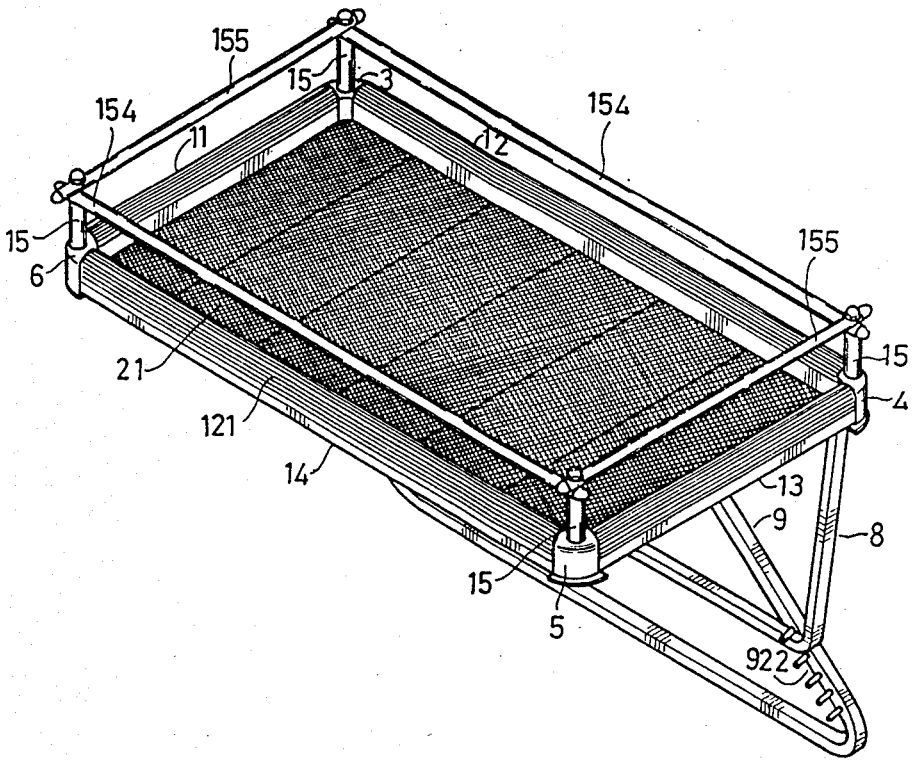
Fig.5 is a perspective view of the present invention.

To assemble the present invention as shown in FIG. 5, a plurality of mesh sections (21) are inserted into the notches (113), (123), (133), (143) on the side frames (11), (12), (13), (14) piece by piece to form a base (2); the extensions (31), (32), (51), (52) on the corner blocks (3), (5) are inserted into the bores (111), (121) at one end of side members (11), (12) and the bores (131), (141) at one end side frames members (4), (6) respectively, the extensions (41), (42), (61), (62) on the two sides of blocks (4), (6) are inserted into the bores (121), (131) at another end of side frames members (12), (13) and the bores (141), (111) at another end of side frames members (14), (11) respectively, so as to form the peripheral frame body (1). Then, the head end (151) of which pillar (15) is inserted into the respective holes (33), (43), (53), (63), the head end (152) of each of two pillars (15) is inserted into the hole (1541) on crossbar (154) which is supported on the catch edge (153). Then the head ends of two pillars (15) are inserted into the holes (1551) on two crossbars (155). The guide blocks (71), (72) of retainers (7) are disposed in the sliding slot (122) of side frame (12), and each retainer (7) may be movably fixed onto the side frame members (12) through a screw passing through the protruded flange (73). Also, the slider flanges (101), (102) are disposed in the sliding slots (112), (132) on the side frames members (11), (13). The head ends of side bars (81), (92) of monopod (8) are threadably engaged in the holes (10111) on the sliders (1011), (0121) respectively, and the head ends of said bars (91), (92) of monopod (9) are threadably engaged to the holes (10211) on the sliders (101), (102) respectively.

Figure 6:
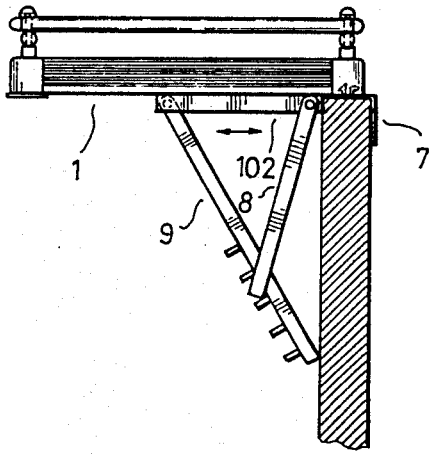
FIG. 6 is a side view of the present invention showing a first form of retainer.
Figure 7:
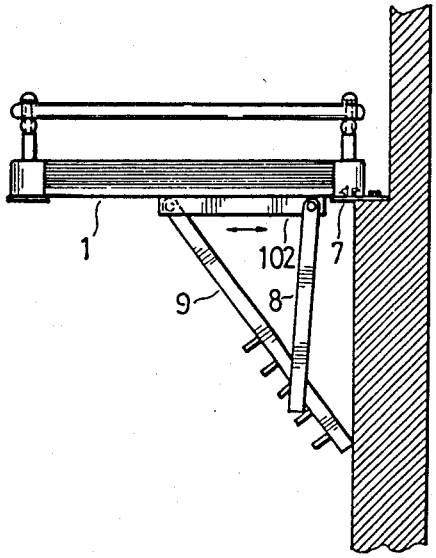
FIG. 7 is a side view of the present invention showing a second form of retainer.
Figure 8:
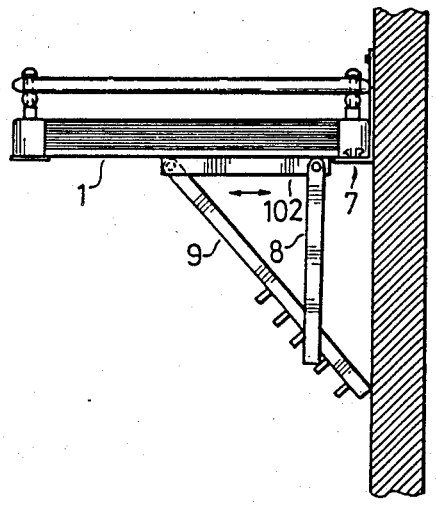
FIG. 8 is a side view of the present invention showing a third form of retainers.

When using the present invention as shown in FIG. 6, the first type of retainer (7) with a hen-over vertical flange is attached on the side of head end of enclosure or railing, then the monopad (8) is caught between two bars (912), (922) on the monopod (9) so that the bottom of monopod (9) is urged against the enclosure or railing whereon the frame body (1) is fixed, whereby the present invention is now ready for use. In practice, since the specifications and thickness of enclosure or railing are different, we can make use of the holes on sliders flanges (101), (102) in keeping with the group of holes on the flange members (114), (134) of side frames (11), (13) for micro adjustment of the inclination of monopod (9) in keeping with a macro adjustment of both monopod (8) along bars (912), (922) so as to positively maintain a perpendicular angle between the frame body (1) and the enclosure or railing. In addition, in case of an enclosure with a window frame, use can be made of the second form of retainer (7) as shown in FIG. 7 to fix the frame body (1) onto the portion of enclosure outside the window frame; and in the case of installing the frame body (1) outside a kitchen, use can be made of the retainer (7) as shown in FIG. 8.

I claim:

1. A shelf structure comprising a substantially planar rectangular shelf base, a peripheral frame surrounding the base and comprising respective elongate side frame members, sliders supported by a pair of the side frame members which are located at opposite sides of the base, adjustment means for selectively fixing the sliders in different positions along the respective side frame members, a depending brace assembly secured to said sliders, the brace assembly including first and second substantially U-shaped braces each having side arms and a cross bar, the side arms of each brace being pivotally secured to the respective sliders at spaced locations on the respective slider, the braces being configured for mutually crossing one another, engagement means on one of the braces for retaining the braces in selected crossed over configurations, and retainer means on a third one of said side frame members for securing the structure to support means, the slider being adjustable along the respective side frames and the crossed over configuration of the braces being adjustable so as to enable one of the braces to engage a vertical surface under the support means and support the shelf structure in a horizontal plane wherein said pair of side frame members each have a bottom-opening slot defined by opposed flanges, wherein the sliders extend through the respective slots and include upper flanges which slide on the flanges of the respective said frame members.

2. The invention as defined in claim 1 wherein the adjustment means comprises a row of holes disposed lengthwise in the respective side frame member, at least one hole in the respective flanges alignable with selected holes in said row, and fastener means for insertion through the respective holes when aligned.

3. The invention as defined in claim 1 wherein the retainer means comprises at least one slide mounted for sliding movement along said third side frame member, and attachment means is provided for selectively securing the slide in adjusted positions along the third side frame member.

4. The invention as defined in claim 1 wherein the side frame members each have an inner longitudinal slot receiving a respective edge portion of the shelf base, and wherein the respective side frame members are interconnected by corner fittings.

5. The invention as defined in claim 4 which includes upright posts on each corner fitting and bars connected between the posts forming a surround for the shelf structure.

* * * * *